United States Patent [19]

Lewiner et al.

[11] Patent Number: 4,692,762

[45] Date of Patent: Sep. 8, 1987

[54] REMOTE CONTROL CODED DEVICES

[76] Inventors: Jacques Lewiner, 5, rue Bory d'Arnex, 92210 Saint Cloud; Claude Hennion, 18, rue Flatters, 75005 Paris, both of France

[21] Appl. No.: 815,751

[22] Filed: Dec. 31, 1985

Related U.S. Application Data

[63] Continuation of Ser. No. 495,401, May 17, 1983, abandoned.

[30] Foreign Application Priority Data

Jun. 4, 1982 [FR] France ..... 82 09791

[51] Int. Cl.[4] ..... G08C 19/00; G08B 5/00

[52] U.S. Cl. ..... 340/825.69; 340/825.72; 340/825.31

[58] Field of Search ..... 340/825.31, 825.34

[56] References Cited

U.S. PATENT DOCUMENTS

| | | | |
|---|---|---|---|
| 3,906,447 | 9/1975 | Crafton | 340/825.31 |
| 4,427,980 | 1/1984 | Fennell et al. | 340/825.44 |
| 4,464,651 | 8/1984 | Duhame | 340/696 |

*Primary Examiner*—Ulysses Weldon
*Assistant Examiner*—Ralph E. Smith
*Attorney, Agent, or Firm*—Larson and Taylor

[57] ABSTRACT

To provide a remote control by means of coded signals, a portable transmitter case (3) is used comprising, on the one hand, a keyboard (5) with keys (6) for directly forming the coded signal on said case and, on the other hand, means for recording this coded signal, for storing it in the memory for a time $t_o$ at the end of which it is automatically erased, as well as a control button (10) ensuring the instantaneous transmission of the signal thus previously stored in the memory.

6 Claims, 1 Drawing Figure

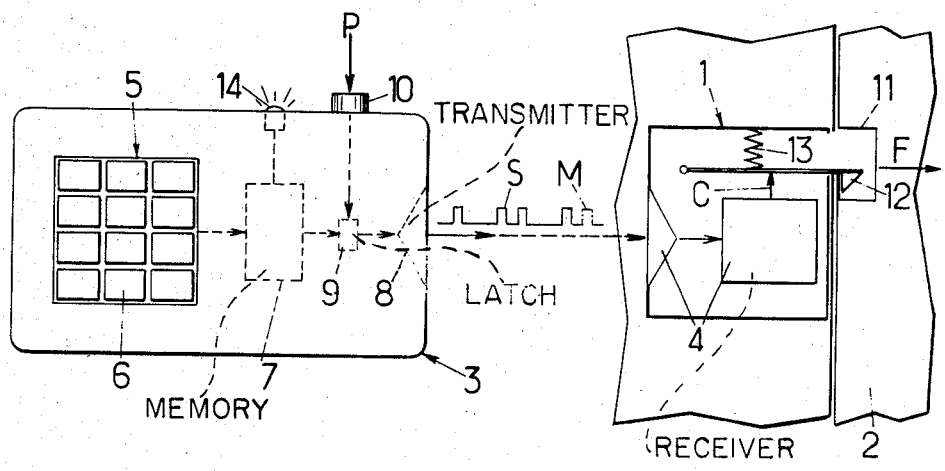
P
5
14
10
TRANSMITTER
S
M
9
8
LATCH
6
7
MEMORY
3
1
11
13
F
C
12
4
RECEIVER
2

REMOTE CONTROL CODED DEVICES

This application is a continuation of application Ser. No. 495,401 filed 5/17/83, now abandoned.

BACKGROUND OF THE INVENTION

1. Field of the Invention

The invention relates to devices providing remote controls, such more particularly as the opening of a garage door, by means of coded signals transmitted in space without any material support.

2. The Prior Art

The invention relates more particularly, among these devices, to those comprising a portable case adapted to emit the coded signals and a receiver mounted on the member to be controlled and adapted to receive these signals, to compare them with a previously recorded reference and to provide the desired control when this comparison reveals identity between a coded signal received and the reference, this control being more especially the unlocking of the door followed by automatic opening of this door.

The advantages offered by remote control devices of this kind are known, which allow more especially motorists to operate the door of their garage without having to get out of their vehicle.

But the known devices of the kind in question present some disadvantages and in particular the following one: the remote control may be easily provided by means of the case by anyone carrying this case and even by those who have not received permission from the owner of said case, such as when said cases is stolen.

To remedy this disadvantage, it has already been proposed to equip the case in question with a keyboard comprising at least two control keys for forming on this case itself the coded remote control signal by a sequence of actuation of the keys of the keyboard in accordance with a predetermined code.

Only the persons who know this code can then effect with the help of the case considered the remote controls for which this latter is intended.

This solution thus protects the owner of the case from unauthorized use of this case.

Such an advantage is precious.

But it is offset by the following disadvantage: forming the code at the very time when the remote control is to be given effect is often irksome and relatively long, requiring in particular for handling the keyboard sufficient lighting and the complete freedom of both hands of the user, which in some circumstances is particularly troublesome, even at the outside prohibitive.

SUMMARY OF THE INVENTION

Accordingly, to overcome such disadvantages, the invention, broadly speaking, provides for further equipping the above-described case with means for recording the remote control coded signal formed by correct sequential actuation of the keys of the keyboard, for storing this signal for a time $t_o$, which may be for example of the order of 5 minutes, and for automatically erasing said signal at the end of this time $t_o$, as well as means for providing the instantaneous transmission of the coded signal thus stored in response to the actuation of a single control member such as a push-button.

In preferred embodiments, recourse is further had to one and/or the other of the following arrangements:

the case comprises means for erasing the coded signal from the memory as soon as it has been transmitted or after a time $t_1$ following its first and possibly only transmission, the case comprises means for automatically renewing the transmission of the coded signal as long as the control member remains actuated, the case comprises means for signalling the periods when a coded signal is stored therein, the signalling means according to the preceding paragraph are adapted so as to display in clear the code itself at the time of its recording and as long as the coded signal remains stored in the memory, the case further comprises means for identifying this case, these means being adapted so as to specially mark each coded signal at the time of its transmission, the receiver being equipped on its side with means adapted for identifying the coded signals thus marked, in a remote control device according to the preceding paragraph, the receiver comprises means for selectively neutralizing the controls due to some of the marked and identified coded signals.

The invention comprises, apart from these main arrangements, certain other arrangements which are used preferably at the same time and which will be more explicitly discussed hereafter.

In what follows, a preferred embodiment of the invention will be described with reference to the accompanying drawing in a way which is of course in no wise limiting.

BRIEF DESCRIPTION OF THE DRAWINGS

The single FIGURE of this drawing shows very schematically a remote control code device constructed in accordance with the invention.

DESCRIPTION OF THE PREFERRED EMBODIMENTS

Generally, it is proposed to provide remotely, with neither wire nor any other material connection, any control whatsoever, which, by way of example which is of course in no wise limiting, will be assumed hereafter to be the unlocking of the lock 1 of a garage door 2, followed by the automatic opening of this door.

For this, the following are needed:

a portable pocket case 3 equipped with means for elaborating and transmitting a coded signal S, and a receiver 4 mounted on the lock 1 or in the immediate vicinity thereof and adapted itself to elaborate an electric control signal C capable of unlocking this lock when there is identity between the signal S and a reference code R previously stored in the receiver.

The means for elaborating and transmitting the signal S comprise:

a keyboard 5 with n keys 6 (the symbol n designating a whole number at least equal to 2 and for example equal to 12 in the embodiment shown schematically in the drawing), an electronic circuit 7 fed from a battery and comprising a memory adapted for storing for a time $t_o$ any coded electric signal elaborated by sequential actuation of keys 6, the sequence of this actuation determining the code of said signal, a member 8 adapted to transmit in the surrounding space the electric coded signals S which it receives and which are generally in the form of a succession of pulses, the transmission in question being preferably provided by electromagnetic or ultrasonic waves, an electronic latch 9 interposed between circuit 7 and transmitter 8, and a push-button 10 or similar easy control member, adapted so that actuation thereof, shown schematically by the arrow P, opens latch 9 and thus ensures the transmission, by member 8, of the signal S previously stored in circuit 7.

The receiver 4 comprises on its side means adapted for receiving the signals S and possibly transforming them into electric signals usable electronically, a memory in which has been stored at least one reference code R, means for comparing each signal S received with this code R and means for emitting an electric control signal C whenever there is identity between the signal S received and code R.

In the drawing, it has been assumed purely by way of illustration that this signal C allows the lock 1 to be unlocked by moving away from its locking position in the staple 11 of the door 2 a hook or similar 12 forming part of the lock against a return force generated by a spring 13, so as to make opening of said door 2 possible by sliding it in the direction of arrow F.

Use of the above-described remote control device is as follows.

When the possessor of case 3 intendes operating the remote control for which this case is intended at a given moment i, he has, prior to this moment, a time of duration $t_o$ for preparing this case for such a purpose.

He may then choose any moment during this time for recording in the case the coded remote control signal by sequentially actuating in accordance with the code known by him the keys of the keyboard of this case.

The moment in question is chosen at a time when he may have both hands free, when he may sufficiently light the keyboard for actuating same etc.

In the embodiment given by way of example, this moment may be the one corresponding to when the motorist stops at a red traffic light not very far from the garage towards which he is making his way.

At the effective time when the remote control must be provided, all the possessor of the case has to do is to actuate the control member 10 just once, which may be carried out under conditions of discomfort, for example in the dark and with a single hand.

In fact, this single and easy actuation of member 10 alone ensures the transmission of the complete previously stored coded signal.

This solution has the further advantage of economizing the energy of the battery, since the duration of the transmission of the coded signal may be extremely short and in particular much shorter than that required for forming same by successive actuation of the keys of the keyboard.

The duration $t_o$ during which the coded signal remains stored in the memory of circuit 7 is advantageously of the order of a few minutes, for example between 3 and 10 minutes.

In some cases, this duration $t_o$ may be adjustable through means easy to actuate mounted on the case.

The circuits of the case for storing and transmitting the coded signals may be adapted so that the transmission of each coded signal is immediately accompanied by erasure of same from the memory.

But it may on the contrary be preferable to hold the recording of each coded signal for a certain time $t_1$ after transmission thereof.

In fact the remote control may require:

a relatively close proximity between case 3 and receiver 4, a relatively precise aiming of transmitter 8 of the case in the direction of the receiver, the axis of this transmitter having to be correctly centered on the receiver, and the absence of any screen opaque to the transmitted radiation in the path thereof.

It may then happen that the conditions of distance, orientation and/or lack of obstruction required for ensuring the remote control desired are not satisfied and that consequently the first transmission of the coded signal does not effectively provide this remote control.

The storage of this signal in the memory after the first transmission thereof then allows it to be again transmitted at least once, and preferably several times, until the conditions required for effective execution of the remote control are satisfied.

Renewal of this transmission may be provided automatically, for example once per second, as long as push-button 10 remains pressed.

It may also be made dependent on each new actuation of push-button 10.

At the end of time $t_1$—which may be of the order of a few minutes, for example between 1 and 5 minutes—the coded signal transmitted at least once is erased from the memory.

The times $t_o$ and $t_1$ may be combined together.

Thus, time $t_1$ may be formed very simply by the end of time $t_o$ itself, which corresponds, as was mentioned above, to the duration of the storage of each coded signal from recording thereof in the case: it is sufficient in this case to make this time $t_o$ relatively long and uninfluencable by actuation of push-button 10.

Or else time $t_1$ may partially take the place of time $t_o$: thus this time $t_o$ may be provided of indefinite length, the end thereof then being determined by that of time $t_1$, which time $t_1$ is itself initiated by the first effective triggering of a coded signal transmission, i.e. by the first actuation of push-button 10.

A number of improvements may be made according to the invention to the above-described remote control and in particular the following.

According to one of these improvements, means are provided for displaying on the case the recorded state of each coded signal in this case.

For this, for example, an indicator light 14 may be provided so as to be lit up for each period $t_o$ subsequent to the recording of a coded signal, this light being extinguished at the end of each of these periods of duration $t_o$ corresponding to automatic erasure of the coded signal.

In another embodiment of this improvement, the display in question is that of the code itself in clear, and is for example in the form of a number written during coding behind an oblong window, more especially in one of the ways usually adopted in pocket calculators.

With this latter variant the user can easily check the accuracy of the previous recording of his code.

Another improvement applies to the case where the remote control considered may be effected from a plurality of separate cases.

This is the case for example in the control of a door of a garage having several parking spaces assigned respectively to several vehicles belonging to different owners, a remote control case being then assigned to each of these owners.

According to the improvement in question, means are provided for identifying the remote control transmissions coming from these different cases, each coded signal S transmitted by one of these cases being specially marked depending on its origin.

Such an identification mark M may for example correspond to one or two coding numbers which are added to a code properly speaking of several numbers, only this code properly speaking being recorded in the case by actuation of the keyboard each time the case is used and the complement assigned to the identification of this case being automatically added to the coded signal on transmission of this latter.

The receiver 4 is then specially adapted on its side so as to identify the different coded signals S with their assigned mark M.

The improvement in question allows the cases transmitting successive controls to be identified, which may be advantageous in numerous applications.

Thus, for the above contemplated application, such an identification, associated possibly with a display and/or local recording, allows the entries and the exits of the different vehicles in the garage to be checked.

The improvement in question may also be used for reducing the disadvantages due to theft or to the loss of one of the cases.

It is then sufficient, in such a situation, to make receiver 4 insensitive to the coded signals S to which is added the mark M corresponding to this stolen or lost case.

Thus, the need to change this code for the receiver and for the whole of the cases is avoided, which change not only requires the collection of all these devices and a technical modification of each one, but also causes obvious sources of annoyance in the habits of the users.

According to yet another improvement, there is provided on case 3 means for checking the charge state of the battery supplying circuits 7–9, these means comprising more especially an indicator light in series with the battery and with an electric switch actuatable from outside the case.

Following which, and whatever the embodiment envisaged, there is finally obtained a remote control device whose construction, operation and advantages follow sufficiently from what has gone before.

As is evident, and as it follows moreover already from what has gone before, the invention is in no wise limited to those of its modes of application and embodiments which have been more especially considered; it embraces, on the contrary, all variations thereof.

We claim:

1. A device for providing remote control of a member by means of coded signals, said device comprising a portable pocket size case including transmitter means for transmitting coded signals and a receiver means, mounted on the member to be controlled, for receiving the coded signals, for comparing coded signals with a previously stored reference and for providing predetermined control of said member responsive to a coded signal received by said receiver means and the reference compared therewith being identical, said transmitter means of the case comprising a keyboard with at least two control keys and means for transforming the sequence of actuation of said keys into said coded signals, said transmitter means further comprising means for recording each of said coded signals, for storing each recorded signal in memory for a period of time $t_0$ of between 3 and 10 minutes and for automatically erasing a stored coded signal at the end of said time period $t_0$ irrespective of whether the stored code signal has been transmitted and means for ensuring instanteous transmission of the stored coded signal in response to actuation of a single control member.

2. The remote control device according to claim 1, characterized in that the transmitter means further comprises means for automatically renewing transmission of the stored coded signal as long as the control member remains actuated.

3. The remote control device according to claim 1, characterized in that the transmitter means further comprises means for signalling periods when a said coded signal is stored therein.

4. The remote control device according to claim 3, characterized in that the signalling means display a code corresponding to the stored coded signal when that coded signal is recorded and for as long as that coded signal remains stored in memory.

5. The remote control device according to claim 1, characterized in that the transmitter means further comprises means for identifying the case by providing a special mark in each of said coded signals at the time of transmission thereof, the receiver means being including means for identifying the coded signals thus marked.

6. The remote control device according to claim 5, characterized in that the receiver means comprises means for selectively overriding control of said member to be controlled responsive to selected ones of the received coded signals including a said mark.

* * * * *